US007921485B2

(12) United States Patent
Biersteker et al.

(10) Patent No.: US 7,921,485 B2
(45) Date of Patent: Apr. 12, 2011

(54) FOLDING PATIENT LIFT DEVICE

(75) Inventors: Melvin C. Biersteker, Los Angeles, CA (US); Colin C. Bain, Stevens Point, WI (US); David J. Genske, Plover, WI (US); Erik J. Bluemner, Stevens Point, WI (US)

(73) Assignee: Joerns Healthcare, LLC, Stevens Point, WI (US)

( * ) Notice: Subject to any disclaimer, the term of this patent is extended or adjusted under 35 U.S.C. 154(b) by 0 days.

(21) Appl. No.: 12/333,734

(22) Filed: Dec. 12, 2008

(65) Prior Publication Data

US 2009/0165203 A1 Jul. 2, 2009

Related U.S. Application Data

(60) Provisional application No. 61/009,257, filed on Dec. 27, 2007.

(51) Int. Cl.
*A61G 7/10* (2006.01)

(52) U.S. Cl. ..... 5/83.1; 5/81.1 R; 5/86.1; 5/87.1

(58) Field of Classification Search ..... 5/87.1, 5/81.1 R, 86.1, 83.1
See application file for complete search history.

(56) References Cited

U.S. PATENT DOCUMENTS

| | | | | |
|---|---|---|---|---|
| 3,394,933 | A | 7/1968 | Benoit | |
| 5,878,450 | A | 3/1999 | Bouhuijs | |
| 6,092,247 | A | 7/2000 | Wilson | |
| 6,119,287 | A | 9/2000 | Phillips | |
| 6,134,725 | A | 10/2000 | Bouhuijs | |
| 6,260,218 | B1 * | 7/2001 | Tsuga | 5/87.1 |
| 6,568,002 | B1 * | 5/2003 | Liljedahl | 5/81.1 R |
| 6,964,070 | B2 | 11/2005 | Hawk et al. | |
| 7,020,913 | B2 | 4/2006 | Van Scheppingen et al. | |
| 2001/0027574 | A1 | 10/2001 | Bouhuys | |
| 2002/0069461 | A1 * | 6/2002 | Egan | 5/81.1 R |
| 2003/0070227 | A1 | 4/2003 | Von Schroeter | |
| 2004/0163173 | A1 | 8/2004 | Downing | |
| 2004/0177441 | A1 * | 9/2004 | Ronne | 5/86.1 |
| 2005/0034231 | A1 * | 2/2005 | Huang | 5/86.1 |
| 2006/0026755 | A1 | 2/2006 | Bain et al. | |

(Continued)

FOREIGN PATENT DOCUMENTS

DE 8521095 U1 10/1985

(Continued)

OTHER PUBLICATIONS

Oxford/Hoyer Advance, Portable and Folding Patient Lift, User Instruction Manual & Warranty, Dec. 2004.

(Continued)

*Primary Examiner* — Robert G Santos
*Assistant Examiner* — Brittany M Wilson
(74) *Attorney, Agent, or Firm* — MacMillan, Sobanski & Todd, LLC

(57) ABSTRACT

A patient lift has a base extending in a forward direction, and a mast mounted relative to the base. The mast includes a hinge configured to allow the mast to be pivoted relative to the base between an upright operative position and a folded position, wherein when the mast is in the folded position the mast is substantially parallel to the base and extends in the forward direction. A latch mechanism is configured to hold the mast in the folded position when the latch mechanism is locked, and to allow the mast to be returned to the upright operative position when the latch mechanism is released. The latch mechanism is configured to automatically lock when the mast is moved to the folded position.

8 Claims, 13 Drawing Sheets

U.S. PATENT DOCUMENTS

| | | | | |
|---|---|---|---|---|
| 2007/0051548 | A1* | 3/2007 | Kosco et al. | 180/208 |
| 2008/0280735 | A1* | 11/2008 | Dickie et al. | 482/62 |

FOREIGN PATENT DOCUMENTS

| | | | |
|---|---|---|---|
| DE | 29720590 | | 2/1998 |
| EP | 0506245 | A2 | 9/1992 |
| EP | 0756858 | A1 | 2/1997 |
| WO | 2006/017637 | | 2/2006 |

OTHER PUBLICATIONS

European Patent Office, Extended Search Report dated Feb. 22, 2010, from related European application.

European Patent Office, Search Report dated Nov. 13, 2009, from related European application.

* cited by examiner

FOLDING PATIENT LIFT DEVICE

RELATED APPLICATIONS

This application claims priority from U.S. Provisional Patent Application Ser. No. 61/009,257, filed Dec. 27, 2007, and entitled LOCK FOR FOLDING PATIENT LIFT.

BACKGROUND OF THE INVENTION

This invention relates in general to the field of mobility devices, and more particularly to personal lift devices of the type that may be used to raise or lower a physically disabled person for the purpose of moving them. Most particularly, this invention relates to a form of lock for a folding personal lift device.

Patient lift devices have been known and used in the past for the purpose of assisting with the mobility of otherwise immobilized patients. An attendant may help physically disabled patients who may have suffered a traumatic injury, stroke or one form of illness or another, and who are unable to move about. With a patient lift device, an attendant can hoist a patient from a bed and move him or her into a wheelchair or other desired location. Patient lift devices permit the patient to be raised or lowered and also permit the patient to be swiveled away from the bed about a vertical support member. Such devices include wheeled support structures that allow the devices to be wheeled from place-to-place in a healthcare facility and used as stand alone equipment (i.e., they are not attached to the floor, ceiling or other fixture in the room).

SUMMARY OF THE INVENTION

This invention relates to a patient lift comprising a base extending in a forward direction, and a mast mounted relative to the base. The mast includes a hinge configured to allow the mast to be pivoted relative to the base between an upright operative position and a folded position, wherein when the mast is in the folded position the mast is substantially parallel to the base and extends in the forward direction. A latch mechanism is configured to hold the mast in the folded position when the latch mechanism is locked, and to allow the mast to be returned to the upright operative position when the latch mechanism is released. The latch mechanism is configured to automatically lock when the mast is moved to the folded position.

This invention also relates to a patient lift comprising a base extending in a forward direction and a mast mounted relative to the base. The mast includes a hinge mechanism that is configured to allow substantially linear movement of the mast relative to the base between an operative position and an initial pivot position. The hinge mechanism is also configured to allow pivotal movement of the mast relative to the base between the initial pivotal position and a folded position. The hinge mechanism is also configured to prevent linear movement of the mast relative to the base when the mast has been pivotally moved from the initial pivotal position toward the folded position.

This invention also relates to a patient lift comprising a base extending in a forward direction and a mast assembly mounted on the base. The mast assembly includes a column extending in a substantially vertical direction and a mast mounted on the column by a hinge mechanism. The hinge mechanism is configured to allow substantially linear movement of the mast relative to the base in a range from an operative position to an initial pivot position. The hinge mechanism is also configured to prevent pivotal movement of the mast relative to the base when the mast is in the range between the operative position and the initial pivot position. The hinge mechanism is also configured to allow pivotal movement of the mast relative to the base when the mast is in the initial pivot position in a second range from the initial pivot position to a folded position.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
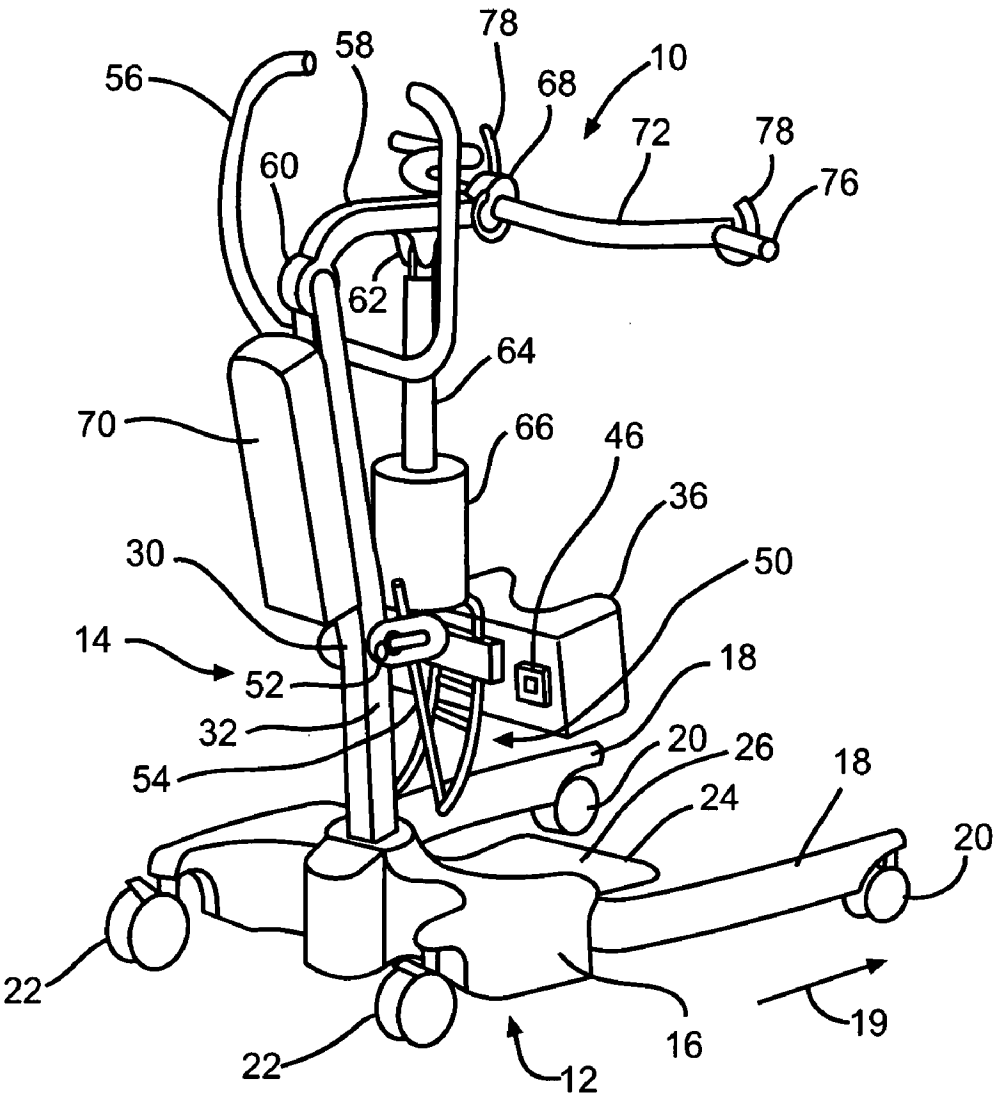
FIG. 1 is a perspective view, taken from behind, of a patient stand assist device.
Figure 5:
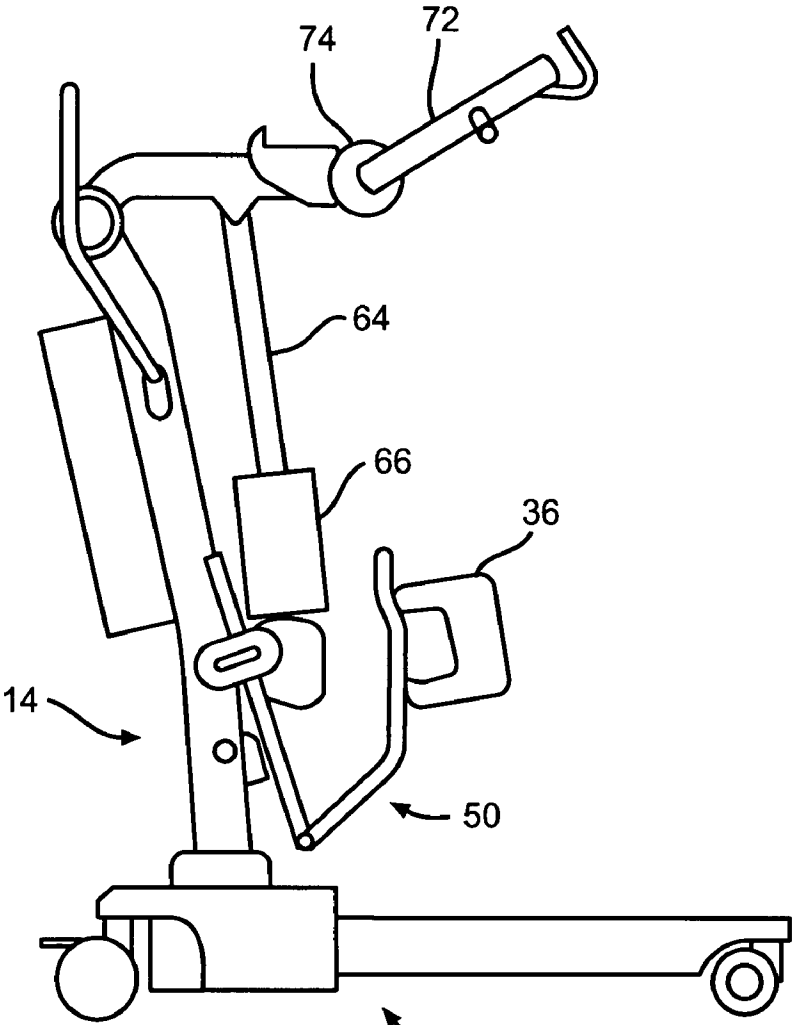
FIG. 5 is a side view of the patient stand assist device of FIG. 1, showing the knee pad in an intermediate position and the support member in a second position.

Referring now to the drawings, there is illustrated in FIG. 1 one embodiment of a patient lift 10. It should be appreciated that the illustrated patient lift 10 is a patient stand assist device. The illustrated patient lift 10 includes a base assembly, indicated generally at 12 and a mast assembly, indicated generally at 14.

The illustrated base assembly 12 includes a base 16. The base assembly 12 also includes a pair of legs 18. The legs 18 extend in a forward direction 19. The illustrated legs 18 are mounted for pivotal movement relative to the base 16. The illustrated legs 18 are configured to rotate about separate hinges having substantially vertical axes. This allows an operator to spread the legs 18 apart or move the legs 18 closer together. The legs 18 can be configured to be moved by foot pedals (not shown) or any other suitable means. The base assembly 12 is configured to provide a stable platform for operation of the patient lift 10.

The illustrated base assembly 12 includes two front castors 20 and two rear castors 22. The illustrated rear castors 22 are braked castors, but it should be appreciated that this is not required. The casters 20 and 22 are configured to support and allow rolling movement of the patient lift 10.

The base assembly 12 also includes an optional foot plate 24. The foot plate 24 includes a step area 26. The step area 26 is configured to support the feet of a patient using the patient lift 10. The illustrated foot plate 24 is mounted for pivotal movement relative to the base 16. The illustrated foot plate 24 is configured to rotate about a hinge having a substantially horizontal axis. This allows the foot plate 24 to be moved so that the patient lift 10 can be used without the patient's using the foot plate 24 or the step area 26. The illustrated foot plate 24 is also configured to be removable from the patient lift 10.

Figure 8:
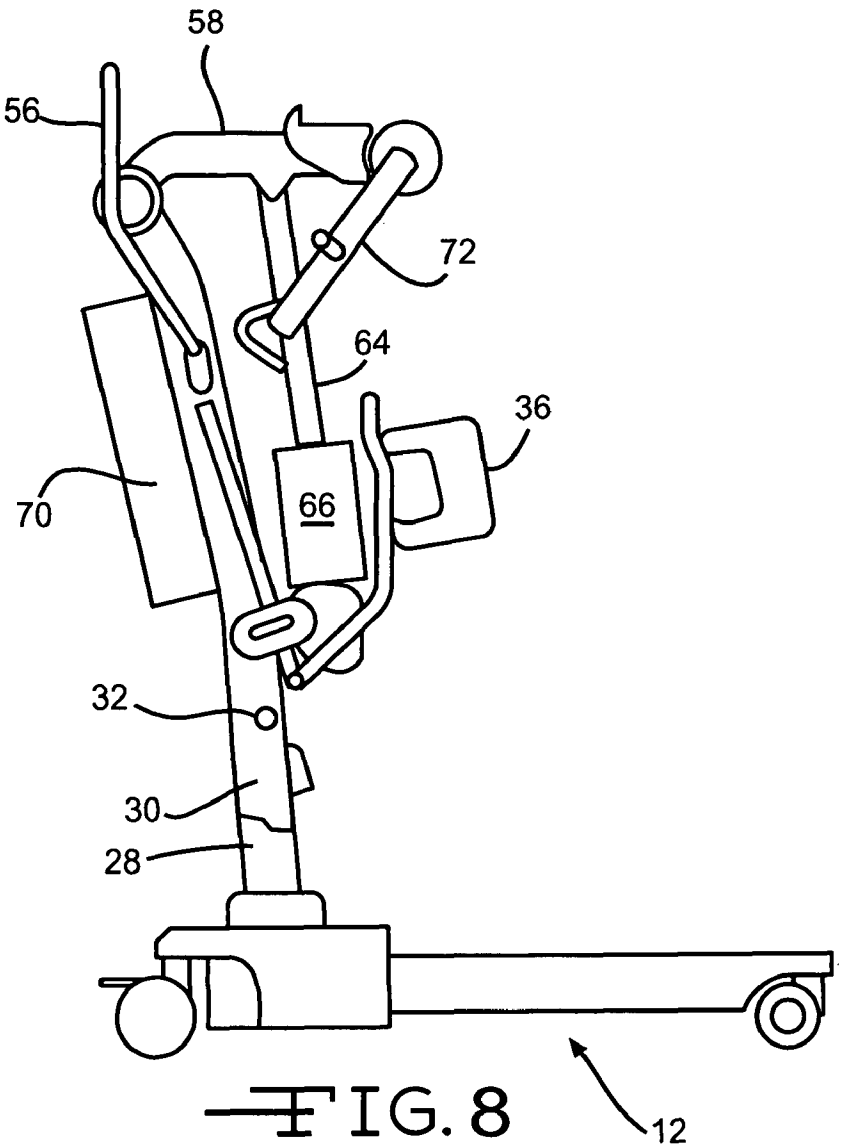
FIG. 8 is a side view of the patient stand assist device of FIG. 1, showing the mast raised to the initial pivot position.

In the illustrated patient lift 10, the mast assembly 14 is attached to the base 16. As best shown in FIG. 8, the mast assembly 14 includes a column 28 that is mounted on the base 16. The illustrated column 28 is disposed with a substantially vertical orientation. It should be appreciated that the column 28 could have a different orientation than that illustrated. The mast assembly 14 includes a mast 30. The lower end of the mast 30 is mounted on the column 28. The mast 30 is a substantially hollow piece, and the inner diameter of the mast 30 is large enough to accommodate the outer diameter of the column 28.

Figure 9:
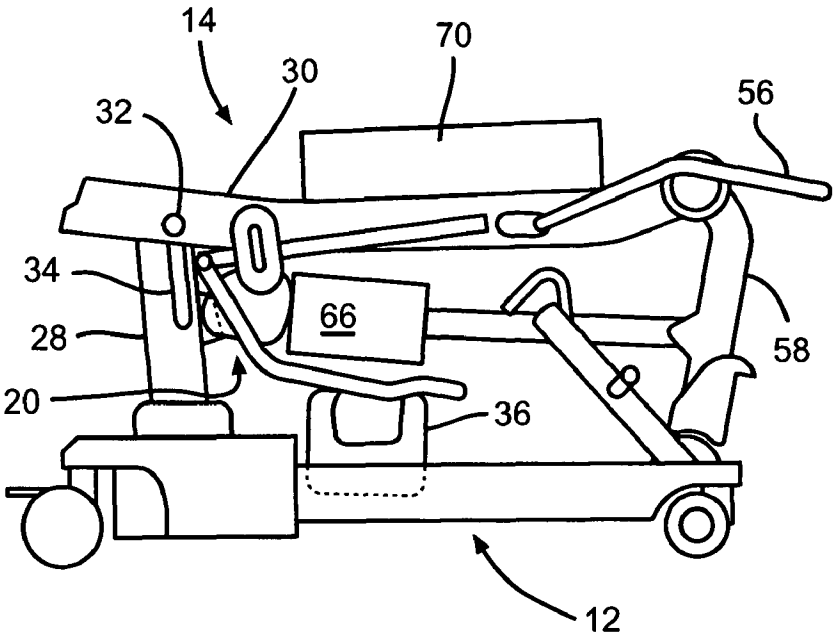
FIG. 9 is a side view of the patient stand assist device of FIG. 1, in the folded position.

A hinge mechanism 32 attaches the mast 30 to the column 28. As will be described in detail below, the hinge mechanism 32 is configured to allow the mast 30 to pivot relative to the column 28. The hinge mechanism 32 is also configured to allow the mast 30 to be moved substantially linearly relative to the column 28. The mast 30 is shown in an upright operative position in FIG. 1. The mast 30 can be move upwards to an initial pivot position, as shown in FIG. 8. From the initial pivot position, the mast 30 can be pivoted to a folded position, as shown in FIG. 9. When the mast 30 is moved into the folded position, the patient lift 10 takes up less space, and is easier to transport and store.

Figure 10:
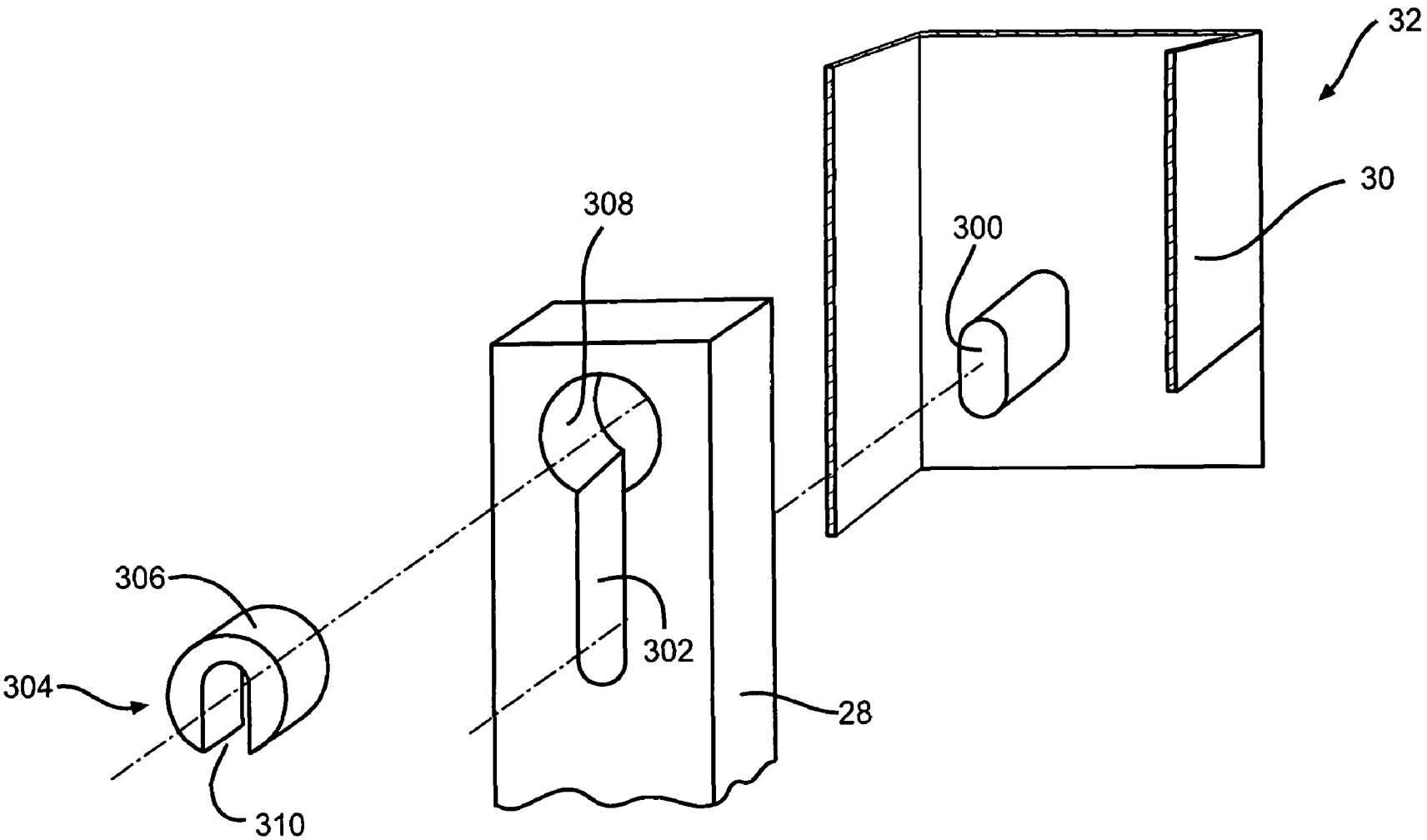
FIG. 10 is a partially cut-away, exploded, perspective view of a hinge mechanism of the patient stand assist device.

Referring to FIG. 10, the hinge mechanism 32 is shown in detail in an exploded, cut-away view. The illustrated hinge mechanism 32 comprises a pivot pin 300 that is attached to the mast 30. The illustrated pivot pin 300 extends from a first lateral side of the mast to the opposite lateral side of the mast 30 and is fixed to the mast 30. The illustrated pivot pin 300 has an oval or oblong cross section, and is mounted to the mast 30 such that the cross-sectional height of the pivot pin 300 is greater than its cross-sectional width. The hinge mechanism 32 also includes a slide channel 302 defined in the column 28. The illustrated slide channel 302 passes completely through the width of the column 28. The slide channel 302 is sized to be large enough to accommodate the cross-sectional width of the pivot pin 300. The slide channel 302 is also not wide enough to accommodate the cross-sectional height of the pivot pin 300. That is, when the pivot pin 300 is in the slide channel 302, the pivot pin 300 is prevented from rotating relative to the slide channel 302 because pivot pin 300 engages the slide channel 302. As a result, when the pivot pin 300 is in the slide channel 302, to the mast 30 is unable to rotate relative to the column 28. The hinge mechanism 32 also includes a hinge or pivot assembly, indicated generally at 304. The illustrated pivot assembly 304 is located at the upper end of the slide channel 302. The pivot assembly 304 includes a detent element 306. The column 28 includes a pivot shaft 308. The detent element 306 is disposed in the pivot shaft 308. The detent element 306 is configured for pivotal movement relative to the column 28. The detent element 306 defines a pivot channel 310. The pivot channel 310 is dimensioned to accommodate the pivot pin 300.

Figure 13:
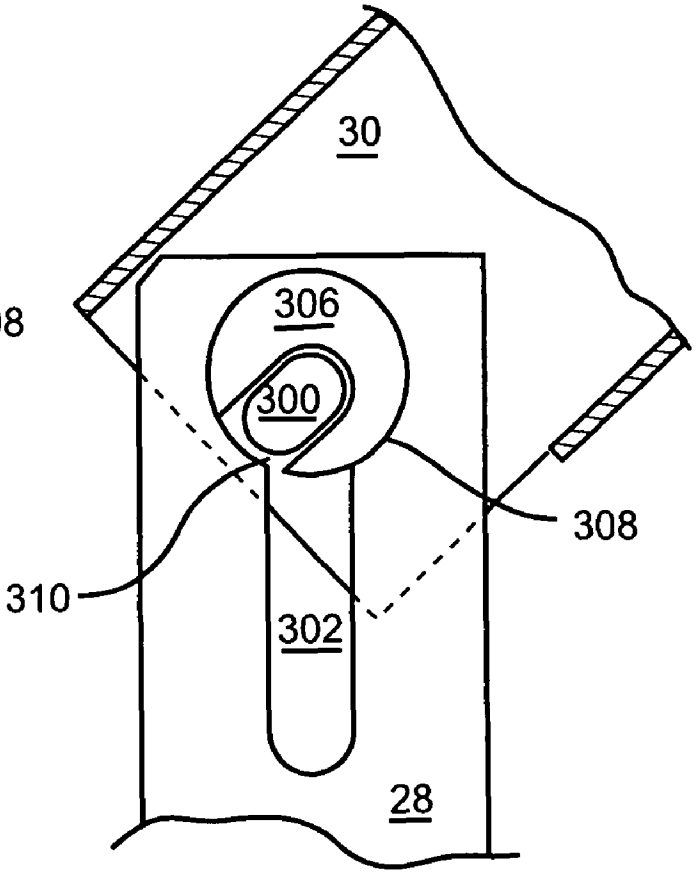
FIG. 13 is a side view of the hinge mechanism of FIG. 12, when the mast has been pivoted from the initial pivot position toward the folded position.
Figure 12:
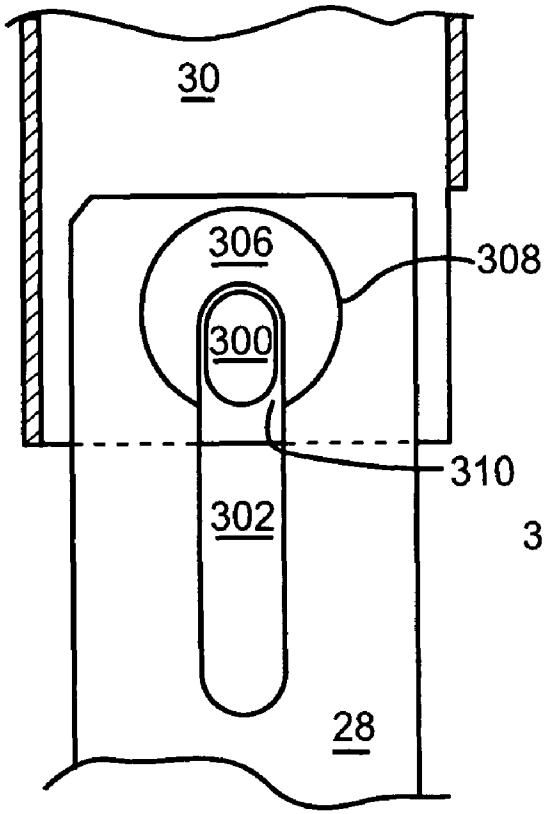
FIG. 12 is a side view of the hinge mechanism of FIG. 11, when the mast has been moved to the initial pivot position.
Figure 11:
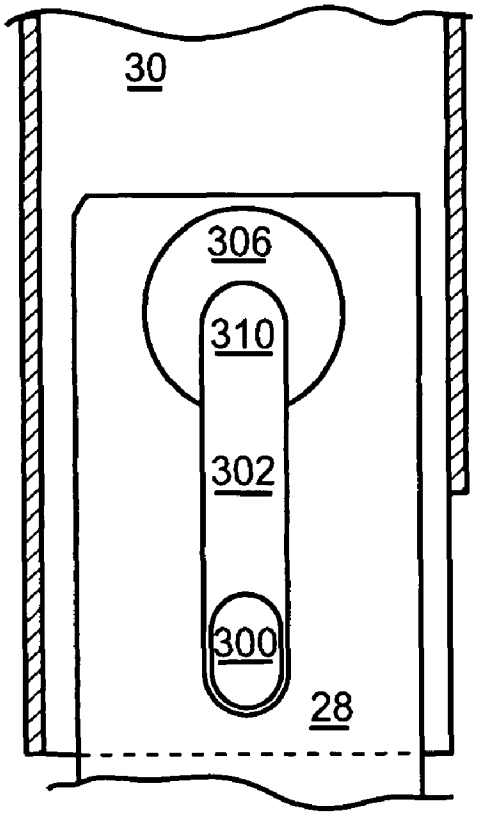
FIG. 11 is a side view of the hinge mechanism of FIG. 10, when the mast is in the operative position.

As shown in FIG. 11, the hinge mechanism 32 is configured so that when the mast 30 is in the operative position, the pivot pin 300 is disposed at the lower end of the slide channel 302. The slide channel 302 is sized to allow the pivot pin 300 to move upwards in the slide channel 302. However, due to the oblong cross sectional shape of the pivot pin 300 in the plane of the slide channel 302, the pivot pin 300 is not able to pivot within the slide channel 302. Therefore, the mast 30 is able to slide upwards from its operative position, but is unable to pivot relative to the column 28. As shown in reference to FIG. 12, the detent element 306 is oriented so that when the pivot pin 300 reaches the upper end of the slide channel 302, the pivot pin 300 enters the pivot channel 310. When the pivot pin 300 enters the pivot channel 310, it can not travel farther vertically. The pivot pin 300 is in the pivot channel 310 when the mast 30 has been lifted to the initial pivotal position. From the initial pivotal position, the mast 30 can be moved back down toward the operating position, with the pivot pin 300 exiting the pivot channel 310 and entering the slide channel 302. From the initial pivotal position, the mast 30 can also be pivoted toward the folded position. As shown in FIG. 13, when the mast 30 is pivoted toward the folded position, the detent element 306 rotates within the pivot shaft 308. This changes the orientation of the pivot channel 310 relative to the slide channel 302. When the pivot channel 310 is not aligned with the slide channel 302, the pivot pin 300 is unable to enter the slide channel 302. Thus, when the mast 30 is pivoted from the initial pivotal position toward the folded position, the mast 30 is unable to move vertically relative to the column 28. The mast 30 can only be moved vertically relative to the column 28 by first pivoting the mast 30 back to the initial pivotal position.

It should be appreciated that while one embodiment of a hinge mechanism 32 has been described in detail, other configurations of hinge mechanisms can be used with the patient lift 10. For instance, two spaced-apart pivot pins could be used in place of the single pivot pin 300 having an oblong cross-section. Or the slide channel 302 may not pass completely through the column 28. Or the pivot pin 300 could be attached to the column 28, and the slide channel 302 and pivot assembly 304 could be located on the mast 30. In that case, the pivot assembly 304 would be positioned at the lower end of the slide channel 302. The illustrated slide channel 302 is linear and has a substantially vertical orientation, and so the mast 30 moves linearly in a substantially vertical direction from the operating position to the initial pivoting position. However, it should be appreciated that the slide channel 302 can have a different configuration and orientation than that illustrated in order to provide different movement of the mast 30 relative to the column 28.

Figure 14:
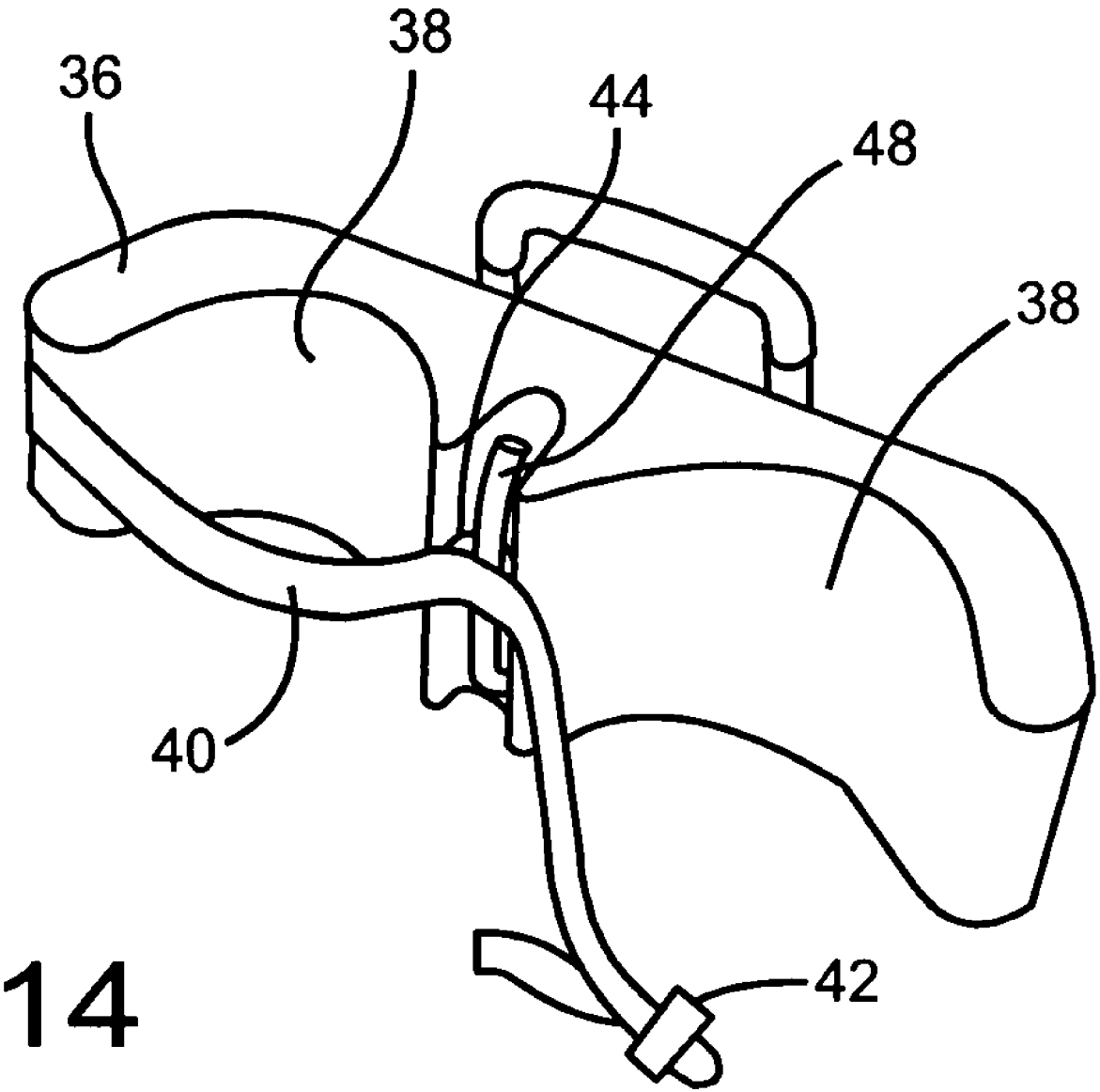
FIG. 14 is a perspective view of the knee pad of the patient stand assist device of FIG. 1, including a strap attached to the knee pad.

The patient lift 10 includes an optional knee pad 36. The knee pad 36 provides support for the patient using the patient lift 10 as a stand assist device. The illustrated knee pad 36 includes optional resilient padding as a cushion for the patient's comfort. As best shown in FIG. 14, the illustrated knee pad 36 includes two recesses 38. Each recess 38 is configured to accommodate one leg of the patient using the patient lift 10. The recesses 38 are configured to provide secure and comfortable engagement between the patient and the patient lift 10. The knee pad 36 also includes an optional strap 40. The strap 40 allows the patient's legs to be held in position when using the patient lift 10. The illustrated strap 40 includes a buckle tongue 42 on each end (only one is visible in FIG. 14), and a central loop 44 in the middle. As best seen in FIG. 1, the knee pad 36 includes two buckles 46 on the side of the knee pad 36 opposite from the recesses 38. It should be appreciated that only one buckle 46 is shown in FIG. 1. The second is not visible because it is behind the mast 30 in this perspective view. The buckles 46 are configured to engage the buckle tongues 42 on the strap 40. The illustrated knee pad 36 also includes a horn 48 located between the two recesses 38. The horn 48 and the central loop 44 are configured so that the central loop 44 can be secured to the horn 48. The illustrated central loop 44 is secured to the horn 48 by sliding the central loop 44 over the upper end of the horn 48.

The combination of the buckles 46 and the horn 48 allow the strap 40 to be used to secure the patient's legs to the knee pad 36 in a number of positions based on the individual patient requirements. For instance, when each buckle tongue 42 is attached to a buckle 46 and the central loop 44 is attached to the horn 48, the most secure engagement with the patient is provided as each of the patient's legs is individually secured. When each buckle tongue 42 is attached to a buckle 46 but the central loop 44 is not attached to the horn 48, the patient is held in engagement with the knee pad 36, but the patient can be released by releasing either buckle 46. This provides greater convenience to an attendant using the patient lift 10. The central loop 44 is attached to the horn 48 and only one of the buckle tongues 42 is attached to a buckle 46 when only one leg is secured to the knee pad 36. This is useful when the patient is missing the lower part of one leg. The central loop 44 is attached to the horn 48 and neither buckle tongue 42 is attached to the buckles 46 for storage of the strap 40. The strap 40 does not secure the patient to the knee pad 36 when the strap 40 is stored like this, but the strap 40 remains secured to the patient lift 10 and is less likely to be misplaced.

Figure 4:
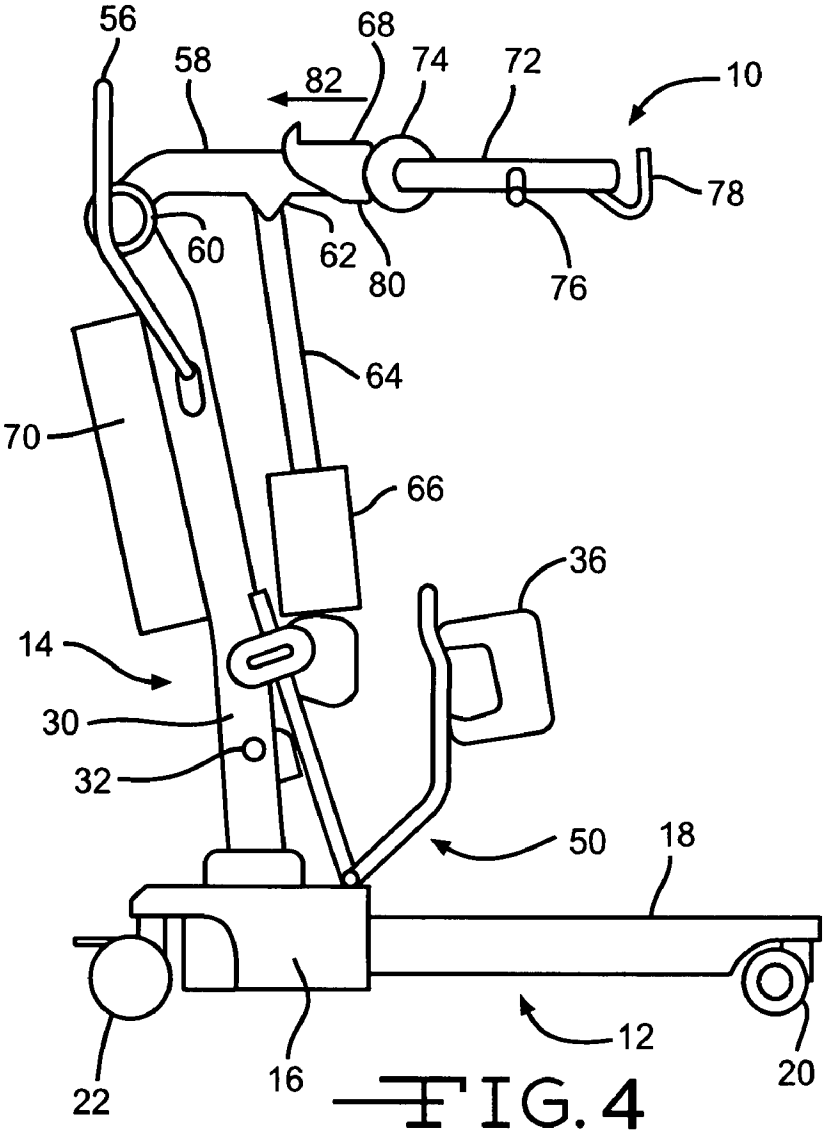
FIG. 4 is side view of the patient stand assist device of FIG. 1, showing the knee pad in a low position and the support member in a first position.
Figure 7:
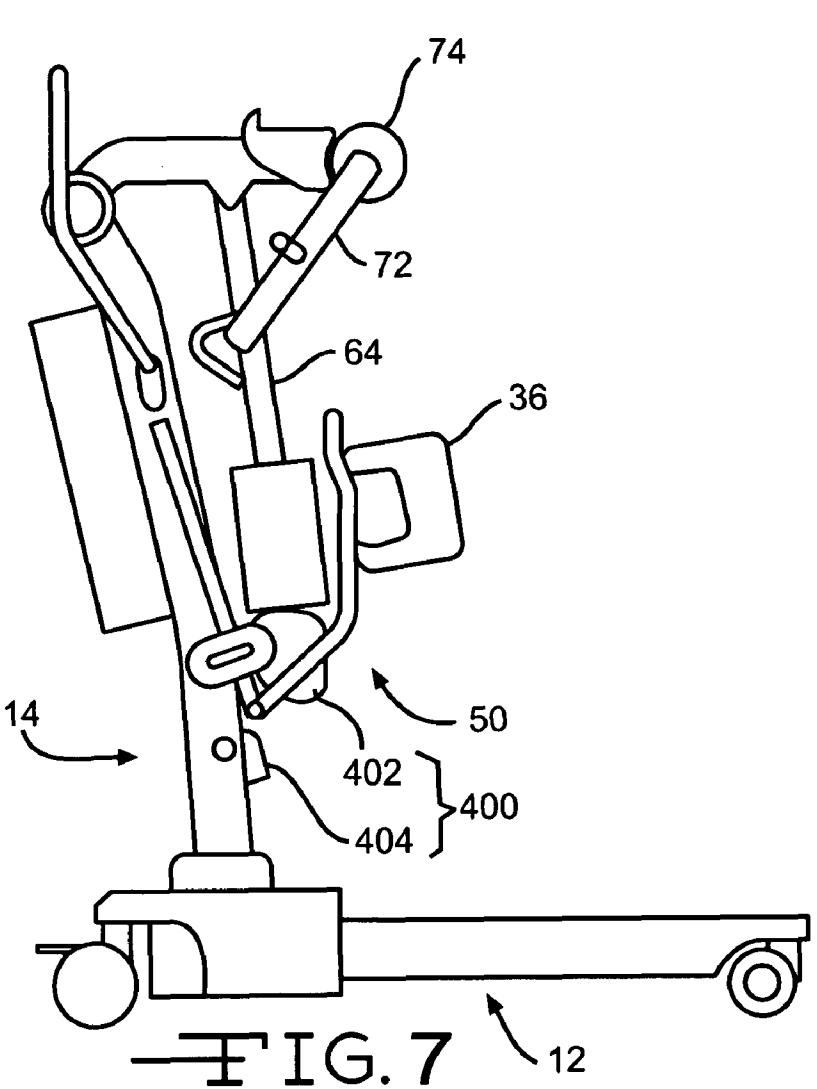
FIG. 7 is a side view of the patient stand assist device of FIG. 1, showing the knee pad in a raised position and the support member in a fourth position.
Figure 6:
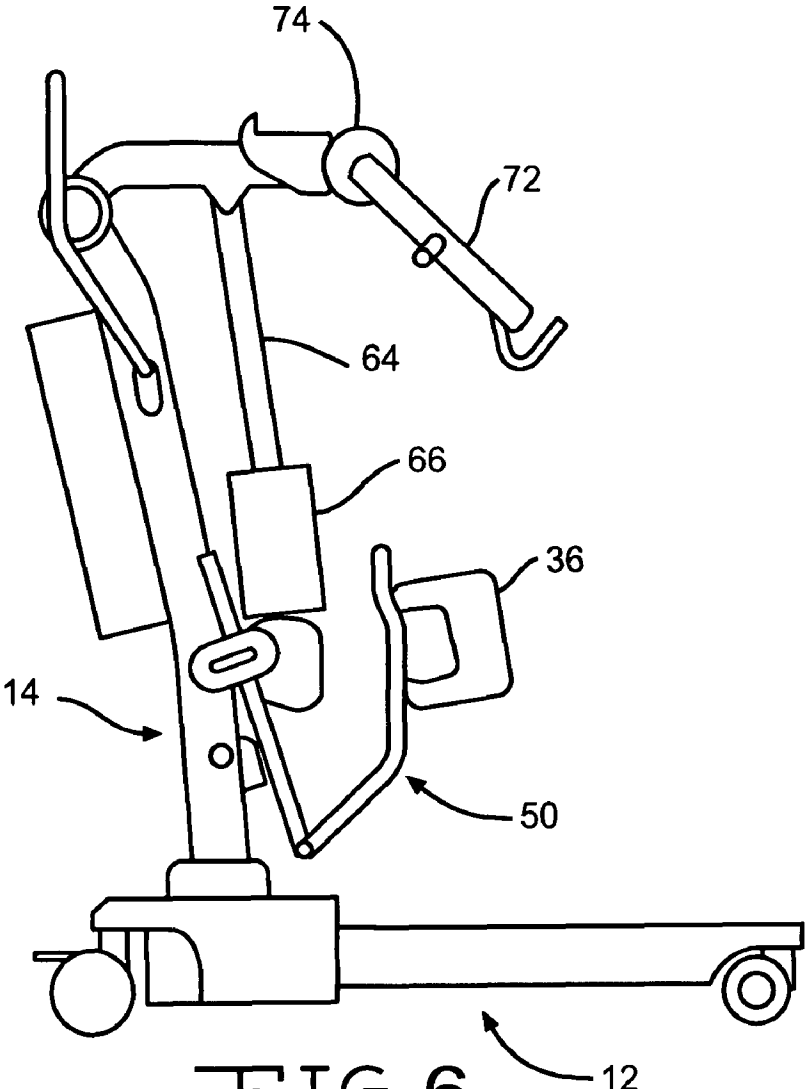
FIG. 6 is a side view of the patient stand assist device of FIG. 1, showing the knee pad in an intermediate position and the support member in a third position.

As best shown in FIGS. 1 and 4, 1 knee pad mounting assembly, indicated generally at 50, attaches the illustrated knee pad 36 to the mast 30. The illustrated knee pad mounting assembly 50 is adjustable to allow the position of the knee pad 36 to be changed for the convenience and comfort of the patient. The knee pad mounting assembly 50 includes a mounting bracket 52. The mounting bracket 52 is attached to a fixed position on the mast 30. The mounting bracket 52 releasably grips a guide tube 54 of the knee pad mounting assembly 50. The height of the knee pad 36 can be adjusted by releasing the mounting bracket 52, sliding the guide tube 54 up or down relative to the mounting bracket 52, and then re-engaging the mounting bracket 52 in order to grip the guide tube 54. The knee pad 36 is shown in a low position in FIG. 4 while it is shown in its most raised position in FIG. 7. The knee pad 36 and knee pad mounting assembly 50 are configured to allow the knee pad 36 to be positioned in a variety of positions throughout an operating range. The operating range is range of positions in which the knee pad 36 is positioned to act as a fulcrum for the patient's knees or legs, and the operating range is selected to accommodate the physiology of anticipated patients. As can be best seen in reference to FIG. 9, the knee pad mounting assembly 50 is configured so that when the knee pad 36 is moved into its most raised position before folding, the knee pad 36 is high enough relative to the mast assembly 14 that it will not interfere with the base assembly 12, particularly the base 16, when the mast 30 is moved into the folded position. That is, as seen in FIG. 9, the knee pad 36 is far enough to the right that it does not interfere with the base 16 when the mast 30 is moved to the folded position. It should be understood that the illustrated knee pad 36 is between the legs 18 when the mast 30 is in the folded position. The illustrated knee pad mounting assembly 50 is configured to provide substantially linear movement of the knee pad 36 through the operating range and to the most raised position. It should be appreciated that this is not necessary, and the knee pad 36 could be configured for some other type of movement. Additionally, the most raised position of the illustrated knee pad 36 is outside the operating range. It should be appreciated that this is not necessary. Movement of the knee pad 36 could be limited to the operating range, for instance.

The illustrated patient lift 10 includes an optional steering handle 56. The illustrated steering handle 56 is mounted on the mast 30. The steering handle 56 is provided to assist the attendant in moving and maneuvering the patient lift 10.

The patient lift 10 includes a boom 58. An inner end of the boom 58 is pivotally attached to the upper end of the mast 30 by a boom hinge 60. The illustrated boom hinge 60 has a substantially horizontal axis. The boom 58 also includes an actuator pivot 62. The illustrated actuator pivot 62 is attached to the upper end of an arm or actuator 64. The actuator 64 may be an electronic ball screw actuator or other suitable actuator. The illustrated actuator 64 is attached to a motor 66. The illustrated motor 66 is also mounted to the mast 30. The motor 66 is configured to extend or retract the actuator 64. By driving the actuator 64, the motor is able to cause the boom 58 to pivot about the boom hinge 60. Pivoting the boom 58 about the boom hinge 60 will either raise or lower an outer end 68 of the boom 58. The illustrated motor 66 is an electric motor, and is powered by a power supply 70. The illustrated power supply 70 is attached to the mast 30. It should be appreciated that any other suitable mechanism may be used to move the boom 58.

Figure 2:
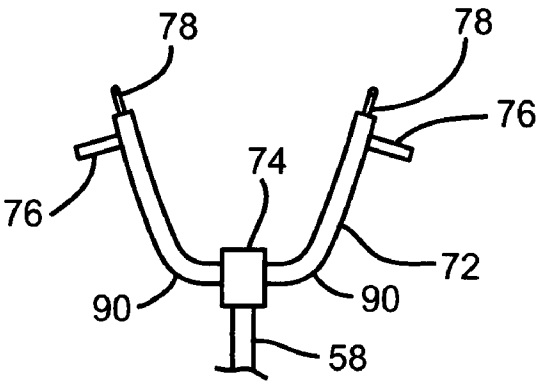
FIG. 2 is a plan view of the support member and a portion of the boom of the patient stand assist device of FIG. 1.
Figure 3:
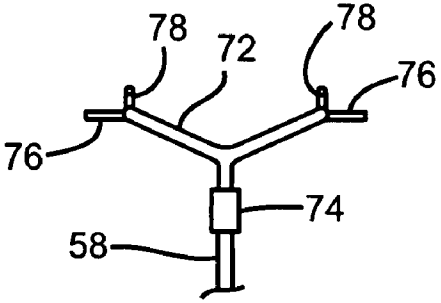
FIG. 3 is an plan view of an alternative, Y-shaped design of a support member suitable for the patient stand assist.

The outer end 68 of the boom 58 supports a pivotally attached support member 72. As best seen in FIG. 2, the illustrated support member 72 is a substantially U-shaped component. The support member 72 is attached to the boom 58 by a locking mechanism 74. The support member 72 includes a pair of optional hand-holds 76. The support member 72 also includes a pair of sling hooks or attachment points 78. One attachment point 78 is located at each end of the support member 72. The attachment points 78 on support member 72 are used to suspend a sling (not shown) used to lift the patient. It should be appreciated that FIG. 2 depicts only one possible configuration of the support member 72. An alternative configuration of support member 72 is illustrated in FIG. 3.

The locking mechanism 74 releasably grips the support member 72. When the locking member 74 is released, the support member 72 is able to rotate around a substantially horizontal axis. When the locking member 74 is engaged, the support member 72 is fixed relative to the boom 58. The illustrated locking mechanism 74 includes a release handle 80. The release handle 80 is configured to be moved by the attendant in a first direction, as indicated by the arrow 82. When the release handle 80 is moved in the first direction, the support member 72 is released for rotation relative to the boom 58. The release handle 80 is spring biased in a second direction, toward the support member 72. When the release handle 80 is moved in the second direction, the support member 72 is no longer able to rotate relative to the boom 58 and the support member 72 is fixed in its current angular position.

The ability to adjust the support member 72 to various angular positions permits the patient lift 10 to accommodate a greater variety of patients. That is, the shape of the patient lift 10 can be changed, and the attachment points 78 can be repositioned to meet the patient's needs. This also allows more compact folding of the patient lift 10.

Figure 25:
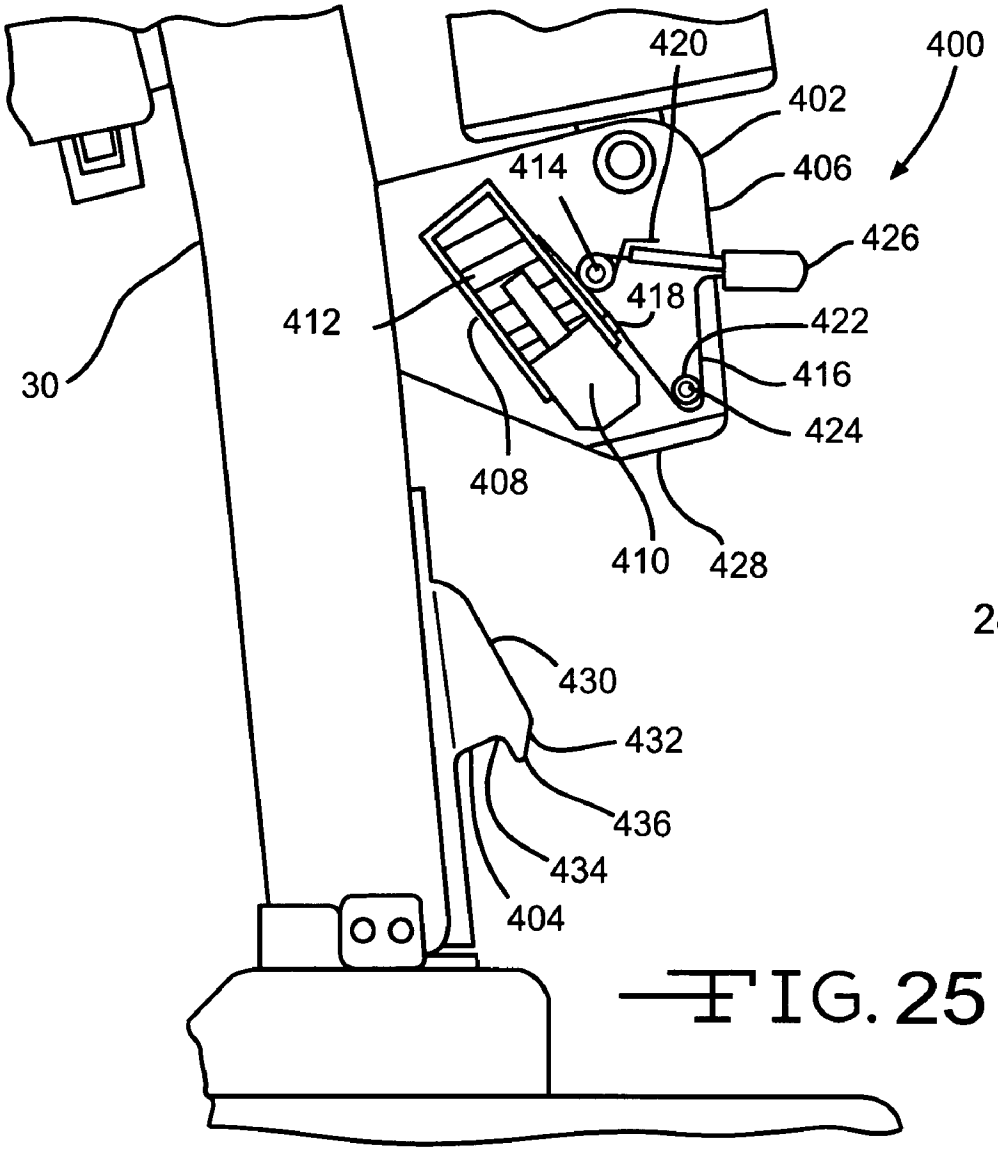
FIG. 25 is a side view, partially in cross section, showing details of a latch mechanism of the patient stand assist device.

As best seen in FIG. 25, the patient lift 10 includes a latch mechanism, indicated generally at 400. The illustrated latch mechanism 400 includes an upper latch assembly 402 and a lower latch member 404. The illustrated upper latch assembly 402 is mounted on the mast 30, and the illustrated lower latch member 404 is mounted on the column 28.

In FIG. 25, the latch mechanism 400 is shown with a partial cut-away view of the upper latch assembly 402. The upper latch assembly 402 includes two upper latch plates 406 that are configured to be mounted to the mast 30 above the point at which the mast 30 pivots. Only one latch plate is visible in FIG. 25, the other latch plate has been removed to make the other components of the upper latch assembly visible. The upper latch assembly 402 includes an impact pin housing 408. The impact pin housing 408 is configured to hold an impact pin 410. The impact pin 410 is configured for sliding movement relative to the impact pin housing 408. An impact pin spring 412 is located in the impact pin housing 408. The impact pin spring 412 is configured to bias the impact pin 410 outward, to the lower right as viewed in FIG. 25.

The upper latch plates 406 support a pivot pin 414. An upper latching member 416 is supported for pivotal movement on the pivot pin 414. A latch stop 418 limits the rotation of the upper latching member. The upper latching member 416 is biased by a latch spring 420 against the latch stop 418, or in the clockwise direction as viewed in FIG. 25. The upper latching member 416 includes a latch pin 422. The illustrated latch pin 422 is fixed relative to the upper latching member. The illustrated latch pin 422 includes a latch pin sleeve 424. The latch pin sleeve 424 is configured to freely rotate around the latch pin 422. The upper latching member 416 also includes a latch handle 426. The latch handle 426 is configured to allow the operator to manually pivot the upper latching member 416 about the pivot pin 414. By applying force on the latch handle 426, the biasing force of the latch spring 420 can be overcome, and the upper latching member 416 can be pivoted away from the latch stop 418. This also causes the latch pin 422 to pivot about the pivot pin 414, in a counterclockwise direction as viewed in FIG. 25. When the operator stops applying force on the latch handle 426, the latch spring 420 will cause the upper latching member 416 to pivot back against the latch stop 418.

The illustrated upper latch plates 406 include a pair of bumper guides 428. One bumper guide 428 is located on each of the upper latch plates 406. Only one bumper guide 428 is visible in FIG. 25, because the other latch plate has been removed to make the other components of the upper latch assembly visible. The configuration of the bumper guides 428 will be described below in connection with the lower latch member 404.

Figure 26:
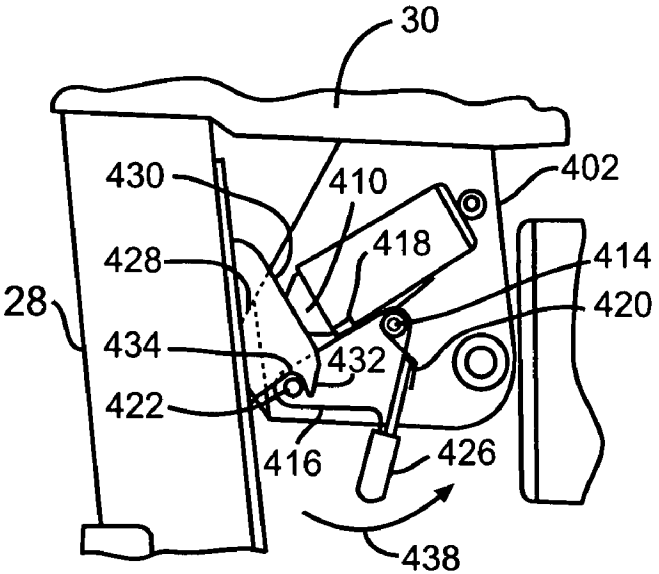
FIG. 26 is a side view, partially in cross section, of the latch mechanism of FIG. 25 with the mast locked in the folded position.

Lower latch member 404 is configured to mount to the column 28 below the point at which the mast 30 pivots. As shown in FIG. 26, the latch mechanism 400 locks when the mast 30 is pivoted to the folded position, and the upper latch assembly 402 and lower latch member 404 meet. In particular, as the mast 30 is pivoted toward the folded position (but before it has reached to position shown in FIG. 26), the bumper guides 428 engage the lower latch member 404 and guide the upper latch assembly 402 in relation to the lower latch member 404. The lower latch member 404 includes an impact surface 430. The latch mechanism 400 is configured so that the impact pin 410 meets the impact surface 430. As the mast 30 is pivoted toward the folded position, the impact pin 410 slides within the impact pin housing 408 and compresses the impact pin spring 412.

The lower latch member 404 includes a latch surface 432. The latch mechanism 400 is configured so that the latch pin 422 meets the latch surface 432. The latch surface 432 is configured so that as the mast 30 is pivoted toward the folded position, the latch surface 432 will act as a cam and the latch pin 422 will act as a follower, and the latch pin 422 will be moved downward. In order for the latch pin 422 to move downward, the upper latching member 416 rotates about the pivot pin 414, against the force of the latch spring 420. The rotatable latch pin sleeve 424 helps the latch pin 422 to slide on the latch surface 432.

The lower latch member 404 includes a latch detent 434. As the mast 30 is pivoted toward the folded position, the previously-described cam action will cause the latch pin 422 to slide to the latch surface end 436. Continued rotation of the mast 30 downward allows the latch pin 422 to clear the latch surface 432. The force of the latch spring 420 will then cause the upper latching member 416 to rotate clockwise as viewed in FIG. 26, and the latch pin 422 will enter the latch detent 434. The latch detent 434 is configured to engage the latch pin 422 so that the mast 30 cannot be raised toward the operative position. The mast 30 is now locked in the folded position. It should be appreciated that in this position the bumper guides 428 have engaged the column 28. The illustrated bumper guides 428 are made of a resilient material that is compressed when the mast 30 is in folded position. The compressed bumper guides 428 help limit movement between the column 28 and the mast 30. It should also be appreciated that in this position, the compressed impact pin spring 412 helps limit movement between the column 28 and the mast 30.

In order to unlock the latch mechanism, the operator applies a force to the latch handle 426 in the unlock direction, indicated by the arrow 438. When the operator applies sufficient force to overcome the biasing force of the latch spring 420, the upper latching member 416 will rotate about the pivot pin 414. By rotating the upper latching member 416 a sufficient distance, the latch pin 422 will clear the larch detent 434, and the mast 30 will be able to be pivoted toward the upright position. It should be appreciated that the compressed impact pin spring 412 and the compressed bumper guides 428 will provide a force assist in moving the mast 30 away from the folded position and toward the upright position.

It should be appreciated that the latch mechanism 400 will automatically lock the mast 30 in the folded position when the operator or attendant pivots the mast 30 into the folded position. It should be appreciated that while one embodiment of the latch mechanism 400 has been described in detail, the latch mechanism can be configured differently from the embodiment described above. Further, the patient lift 10 could not have a latch mechanism to lock the mast 30 in the folded position.

Figure 17:
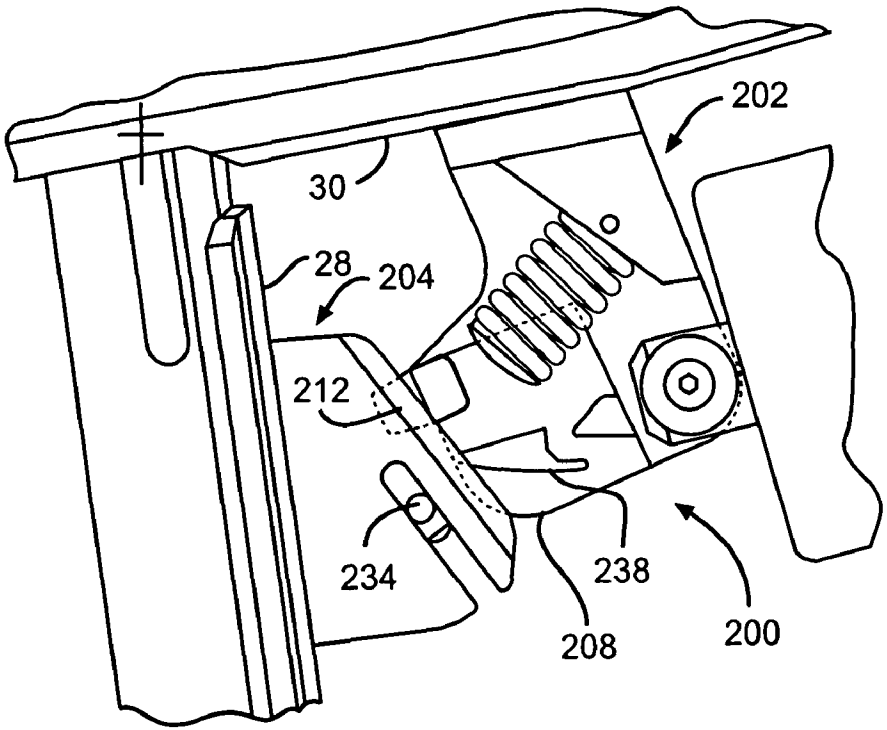

Referring now to FIG. 17, an alternative latch mechanism, indicated generally at 200, suitable for use with the patient lift 10 is shown. Alternative latch mechanism 200 is a push-to-lock, push-to-unlock mechanism. As will be described in greater detail below, the alternative latch mechanism is configured to lock when the mast is pivoted from the upright operative position to in the folded position, and is further configured to unlock when the mast is pivoted further away from the upright operative position. The illustrated alternative latch mechanism 200 includes a first part 202 and a second part 204. The illustrated first part 202 is suitable for mounting on the mast 30 (in place of the upper latch assembly 402), and the illustrated second part 204 is suitable for mounting on the column 28 (in place of the lower latch member 404).

Figure 15:
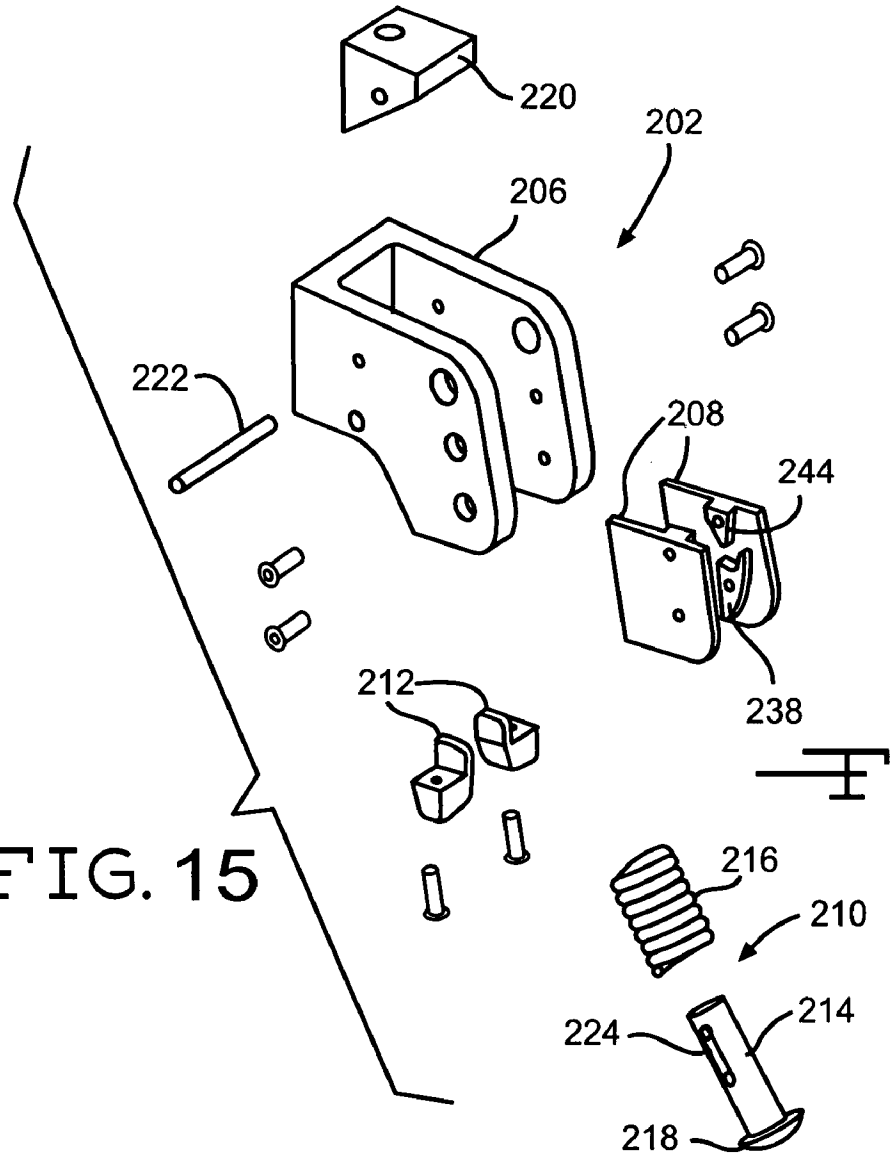
FIG. 15 is an exploded, perspective view of the first part of the alternative latch mechanism of the patient stand assist device.
Figure 18:
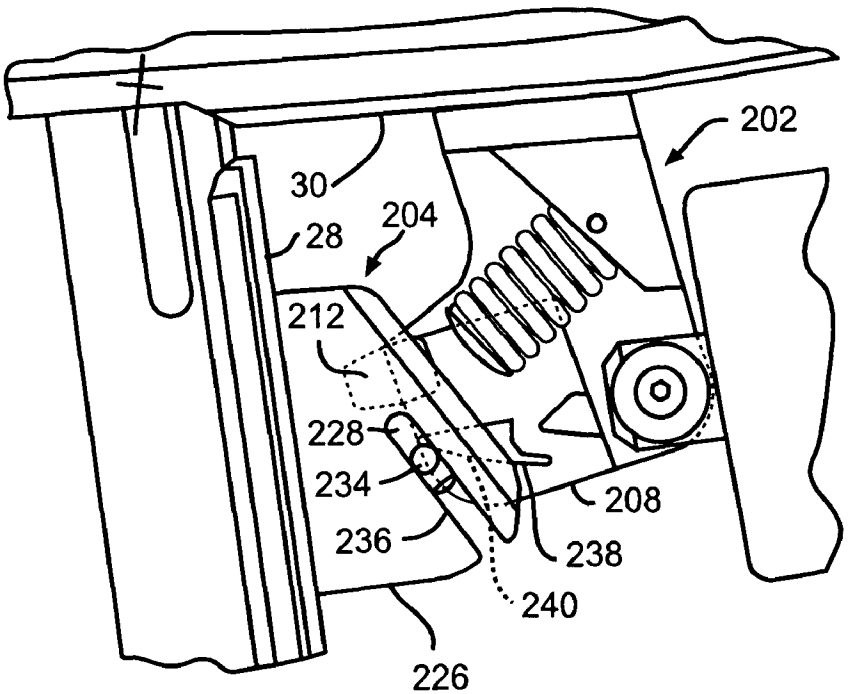
FIGS. 17 through 21 are side views, partially cut-away, of the alternative latch mechanism being locked.

Referring to FIG. 15, an enlarged exploded view of the first part 202 is shown. The first part 202 includes a first bracket 206 that is configured to be mounted to the mast 30 above the point at which the mast 30 pivots. The first bracket 206 houses a pair of opposing latch plates 208 and a spring pin assembly, indicated generally at 210. Resilient contact members 212 are supported by the first bracket 206 for engagement with a second part 204 of the alternative latch mechanism 200, as will become apparent in the description that follows. The opposing latch plates 208 are supported in relation to opposing inner surfaces of the first bracket 206. This may be done in any suitable manner, such as by the fasteners shown. The spring pin assembly 210 may take on any suitable form, including a first spring pin 214, which carries a helical spring 216. The helical spring 216 is supported between a pin head 218 and a spring pin support block 220.

The spring pin 214 is mounted for sliding movement in relation to the spring pin support block 220 by a roll pin 222, which also holds the spring pin support block 220 in fixed relation to the first bracket 206. The roll pin 222 passes through the first bracket 206, the spring pin support block 220, and an elongate travel slot 224 through the spring pin 214. The elongate travel slot 224 allows the spring pin 214 to move in relation to the roll pin 222 and spring pin support block 220. The resilient contact members 212 may be attached to the first bracket 206 in any suitable manner, such as by the fasteners shown.

Figure 16:
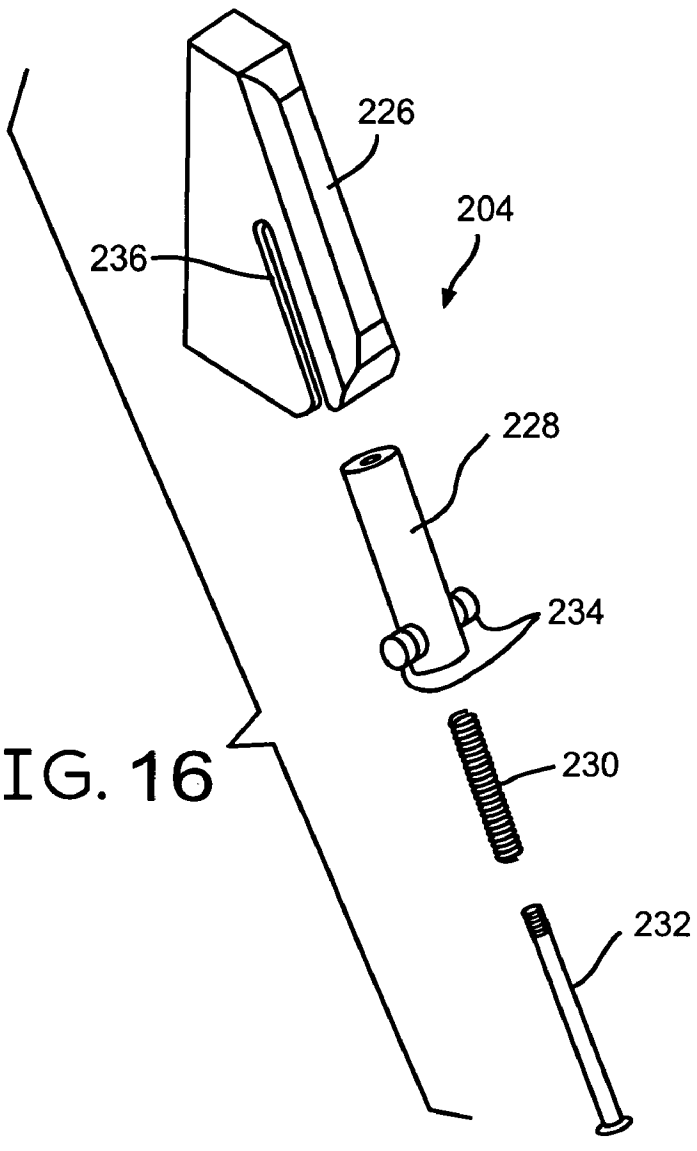
FIG. 16 is an exploded, perspective view of the second part of the alternative latch mechanism of the patient stand assist device.

Referring to FIG. 16, there is illustrated an enlarged view of the second part 204 of the alternative latch mechanism 200. The second part 204 includes a second bracket 226 that is configured to mount to the mast 30 below the point at which the mast 30 pivots. The second bracket 226 houses a latch pin carrier 228, a second helical spring 230 for biasing the latch pin carrier 228, and a fastener 232 for retaining the latch pin carrier 228 and the second helical spring 230 for movement in relation to the second bracket 226. The latch pin carrier 228 carries a follower or latch pin 234 that travels along and extends from a slot 236 in the second bracket 226.

As illustrated in FIGS. 17 through 21, the alternative latch mechanism 200 locks when the mast 30 is pivoted to the folded position, and the first part 202 and the second part 204 meet, as shown in FIG. 17. In particular, the resilient contact members 212 engage the second part 204 and guide the first part 202 in relation to the second part 204. As can be seen in reference to FIG. 18, pushing down on the mast 30 causes the opposing latch plates 208 to engage the latch pin 234. More particularly, a cam member 238 supported by the opposing latch plates 208 engages the latch pin 234. At this juncture, the first part 202 is fully guided in relation to the second part 204 by the resilient contact members 212. A cam action between a first cam surface 240, defined by the cam member 238, against the latch pin 234 urges the latch pin 234 downward (as viewed in FIG. 18) along the slot 236 in the second bracket 226 as the latch pin 234 travels along the first cam surface 240. This moves the latch pin carrier 228 down, compressing the second helical spring 230 (not visible in FIG. 18).

Figure 20:
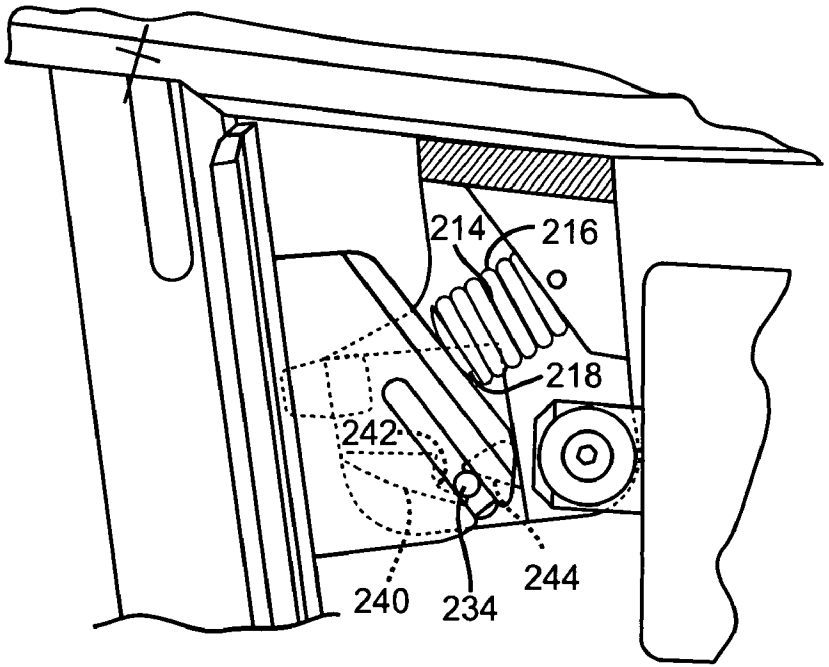
Figure 19:
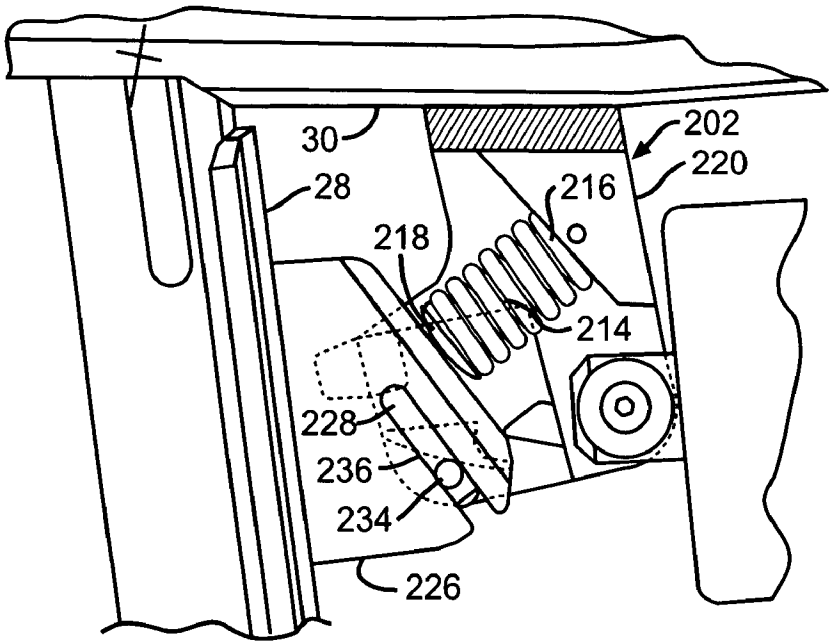

As shown in FIG. 19, further pivoting of the mast 30 downward causes the pin head 218 to engage the second bracket 226 of the second part 204. This, in turn, moves the spring pin 214 in relation to the spring pin support block 220. The movement of the spring pin 214 compresses the helical spring 216 between the pin head 218 and the spring pin support block 220, as shown in FIG. 20. In further reference to FIG. 19, the further pivoting of the mast 30 downward also urges the latch pin 234 downward along the slot 236 due to the cam action between the first cam surface 240 and the latch pin 234. This urging of the latch pin 234 further moves the latch pin carrier 228 down and further compresses the second helical spring 230.

As shown in FIG. 20, further pivotal movement of the mast 30 downward causes the latch pin 234 to reach the end of the first cam surface 240, where the latch pin 234 is guided onto a guide member 244. In reference to FIG. 21, decompression of the helical spring 216 and the second helical spring 230 urges latch pin carrier 228 up, moving the latch pin 234 into a detent 242 in the cam member 238. The latch pin 234 is retained in the detent 242 by the compressive force of the helical spring 216 and the second helical spring 230. At this juncture, the mast 30 is locked in the folded position. The resilient contact members 212 engage the column 28 to tightly lock the mast 30 in the folded condition. At this juncture, the mast 30 has not been pivoted as far downward as the mast 30 will go, but the mast 30 is held in place by the helical spring 216 and the second helical spring 230.

Figure 22:
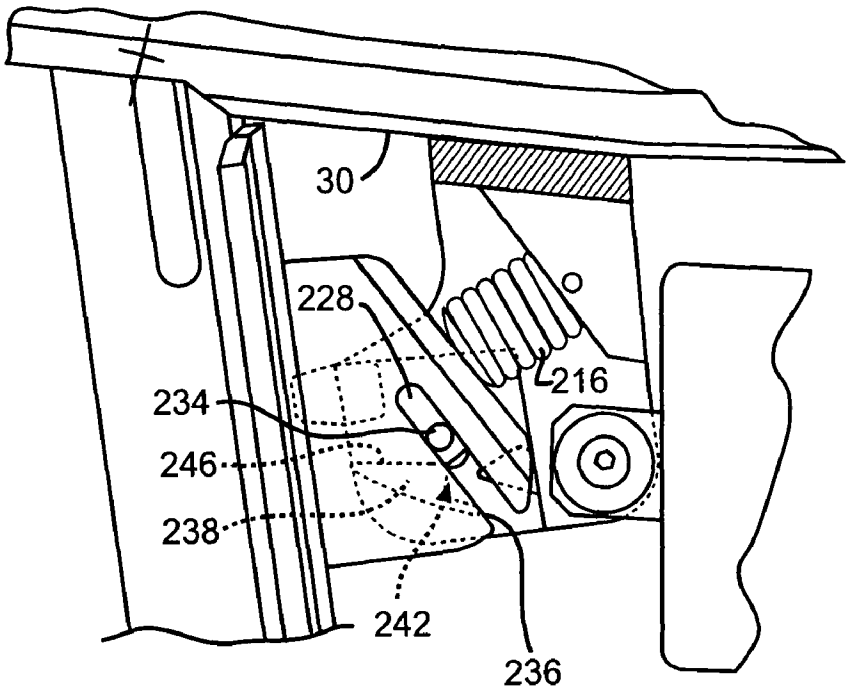
FIGS. 22 through 24 are side views, partially cut-away, of the alternative latch mechanism being unlocked.
Figure 21:
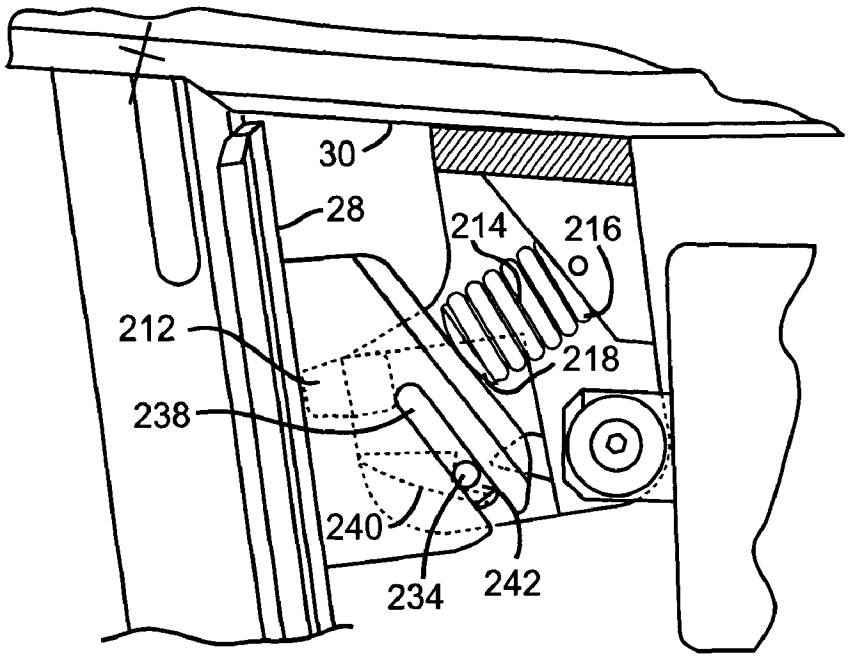

FIG. 22 illustrates the mast 30 pivoted further downward, further away from the initial pivot position, and the alternative latch mechanism 200 releasing. The mast 30 has been pivoted against the force of the helical spring 216. This allows the latch pin 234 to be released from the detent 242, to clear the cam member 238, and to return (upwards in FIG. 22) along the slot 236 in the second bracket 226 by the decompressing force of the second helical spring 230. This urges the latch pin carrier 228 upward to a sweet spot or neutral position. At this juncture, the second helical spring 230 is in a neutral position and the mast 30 is down as far as it can go.

Figure 24:
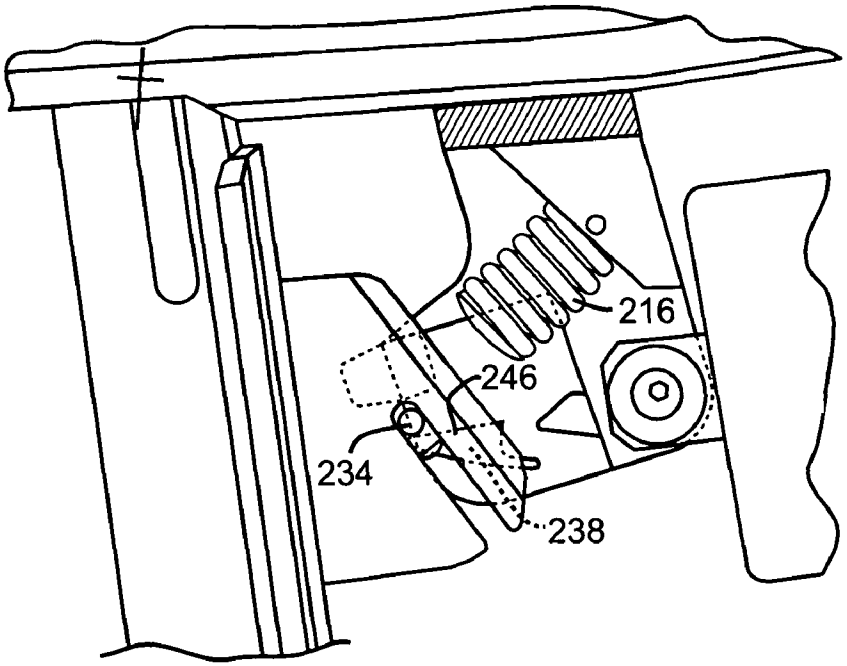
Figure 23:
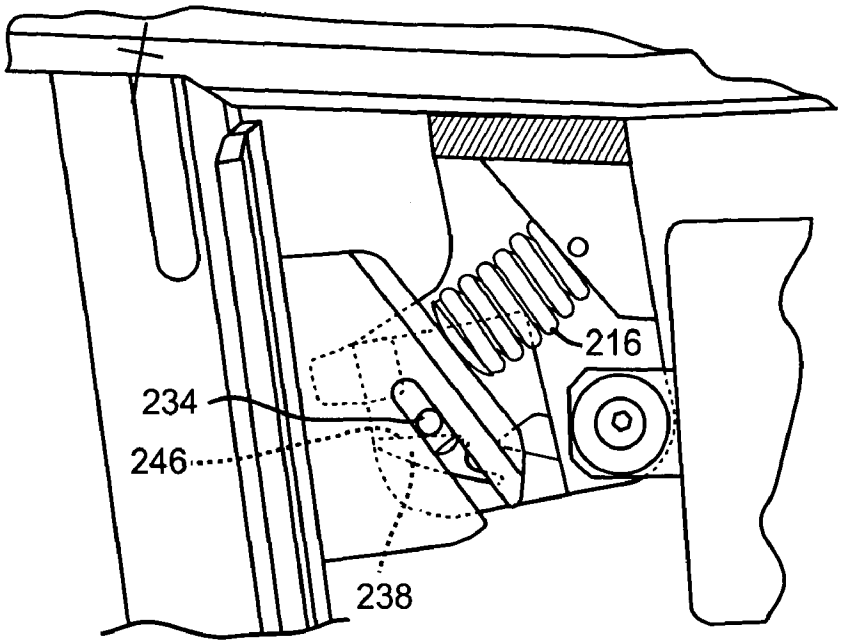

Referring now to FIG. 23, pulling the mast 30 up causes the latch pin 234 to cam against a second cam surface 246 defined by the cam member 238, urging the latch pin 234 up, as shown in FIG. 24. This pushes the latch pin carrier 228 up against gravity. Pivoting the mast 30 further up, toward the initial pivot position, causes the latch pin 234 to reach the end of the second cam surface 246, as shown in FIG. 24. At this juncture, the helical spring 216 is completely decompressed. Further pulling of the mast 30 up causes the latch pin 234 to clear the cam member 238 and return along the slot 236 in the second bracket 226 by gravity via downward movement of the latch pin carrier 228 to the sweet spot or neutral position, as shown in FIG. 17. At this juncture, the mast 30 is completely unlocked and can be pivoted to the initial pivot position.

It should be understood that the latch mechanism may broadly include an automatic locking feature to lock the mast 30 when folding the patient lift and manual or automatic unlocking feature to unlock the mast 30 when unfolding the patient lift. The latter feature could be accomplished in any suitable manner, such as by a lever, a button, or the "push again" feature, as described above.

When used as a stand assist, the patient lift 10 is positioned in front of a patient. The legs 18 may be adjusted in width to provide a stable base arrangement. The patient's feet may be situated on the foot plate 24. A sling (not shown) may be suspended from the attachment points 78. The sling is passed behind the patient's back and under the patient's arms. The motor 66 is driven to extend the actuator 64. As the actuator 64 is extended, it pivots the boom 58 around the boom hinge 60, and raises the outer end 68 of the boom 58. This also raises the support member 72, and the attached sling. The support member 72 can be raised until the patient is completely supported by the foot plate 24 or the support member 72 and the desired height is reached.

When used as a patient lift, the patient lift 10 may be positioned adjacent the patient and stabilized by adjustment in width of the legs 18. A sling (not shown) may be placed under the patient and suspended from the attachment points 78. The motor 66 then drives the actuator 64 to raise the support member 72 in order to lift the patient. The patient may be completely supported by the sling. That is, the patient's weight is supported entirely by the patient lift 10 through the sling. When used as a patient lift, the patient's feet are not supported by the foot plate 24, and the foot plate 24 can be removed from the patient lift 10.

The patient lift 10 may be used as a walking device for the patient. When used as a walking device, the support member 72 is generally lowered to make it comfortable for the patient to use the hand-holds 76 and the foot plate 24 is removed. This helps the patient to comfortably hold either the hand-holds 76 or the support member 72 while walking.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A patient lift comprising:

a base extending in a forward direction;

a mast having a lower end, the lower end of the mast mounted relative to the base, the mast including a hinge configured to allow the mast to be pivoted relative to the base between an upright operative position and a folded position, wherein when the mast is in the folded position the mast is substantially parallel to the base and extends in the forward direction; and a latch mechanism configured to hold the mast in the folded position when the latch mechanism is locked, the latch mechanism further configured to allow the mast to be returned to the upright operative position when the latch mechanism is released, the latch mechanism further configured to automatically lock when the mast is moved to the folded position, and the latch mechanism further configured to bias the mast away from the folded position when the latch mechanism is released.

2. The patient lift of claim 1, wherein when the mast is in the folded position the latch mechanism is configured to be released by pivoting the mast further away from the upright operative position.

3. The patient lift of claim 1 wherein the mast is part of a mast assembly, the mast assembly including a column mounted on the base, the column extending in a substantially vertical direction, the mast attached to the column by the hinge.

4. The patient lift of claim 3 wherein the latch mechanism comprises a follower that is supported in relation to one of the column and mast of the mast assembly and a cam member that is supported in relation to the other one of the column and mast of the mast assembly, wherein the follower is configured to engage the cam member and lock the latch mechanism when the mast assembly is moved to the folded position and wherein the follower disengages the cam member to release the latch mechanism.

5. The patient lift of claim 4 wherein the latch mechanism is configured so that when the mast assembly is in the folded position the latch mechanism is released by pivoting the mast assembly further away from the upright operative position.

6. The patient lift of claim 4 wherein the latch mechanism is configured so that the follower enters a detent to lock the latch mechanism, and the latch mechanism is released by removing the follower from the detent.

7. The patient lift of claim 1 wherein the latch mechanism is a push-to-lock, push-to-unlock mechanism.

8. The patient lift of claim 1 wherein the latch mechanism comprises a first part mounted on the mast above the hinge and a second part mounted below the hinge, the first part and the second part configured to be engaged to each other to lock the mast in the folded position and further configured to disengage to release the mast from the folded position.

* * * * *